US007534313B2

(12) United States Patent
Braziunas

(10) Patent No.: US 7,534,313 B2
(45) Date of Patent: May 19, 2009

(54) SYSTEMS AND METHODS FOR CONTROLLING HEAT TREATING ATMOSPHERES AND PROCESSES BASED UPON MEASUREMENT OF AMMONIA CONCENTRATION

(76) Inventor: Vytas Braziunas, 2530 W. Parnell Ave., Milwaukee, WI (US) 53221

( * ) Notice: Subject to any disclaimer, the term of this patent is extended or adjusted under 35 U.S.C. 154(b) by 338 days.

(21) Appl. No.: 10/533,498

(22) PCT Filed: Nov. 12, 2003

(86) PCT No.: PCT/US03/36057

§ 371 (c)(1),
(2), (4) Date: Feb. 14, 2006

(87) PCT Pub. No.: WO2004/044248

PCT Pub. Date: May 27, 2004

(65) Prior Publication Data

US 2006/0138718 A1 Jun. 29, 2006

Related U.S. Application Data

(60) Provisional application No. 60/425,530, filed on Nov. 12, 2002.

(51) Int. Cl.
*C21B 7/24* (2006.01)

(52) U.S. Cl. ..... 148/508; 266/44; 266/80; 266/99

(58) Field of Classification Search ..... 266/78, 266/80, 99, 44; 148/508
See application file for complete search history.

(56) References Cited

U.S. PATENT DOCUMENTS

| | | | | |
|---|---|---|---|---|
| 3,011,873 | A * | 12/1961 | Davis | 148/508 |
| 4,817,659 | A * | 4/1989 | Sutt | 137/88 |
| 5,767,383 | A | 6/1998 | Keil et al. | |
| 5,801,296 | A | 9/1998 | Keil et al. | |
| 7,091,043 | B2 * | 8/2006 | Itou et al. | 436/113 |

FOREIGN PATENT DOCUMENTS

| | | |
|---|---|---|
| JP | 54-024698 | 2/1979 |

* cited by examiner

*Primary Examiner*—Scott Kastler
(74) *Attorney, Agent, or Firm*—Ryan Kromholz & Manion S.C.

(57) ABSTRACT

Systems and methods for determining an ammonia content of an ammonia-based atmosphere. The systems and methods provide a measurement vessel (70). The systems and methods provide an ammonia-based atmosphere conveyed into the measurement vessel (70). The systems and methods provide water conveyed into the measurement vessel (70), with the water causing dissociation of the ammonia from the atmosphere within the measurement vessel (70). The systems and methods measure a flow rate of water into the measurement vessel (70) during the dissociation. The systems and methods determine the ammonia content in the atmosphere based, at least in part, upon the flow rate of water.

22 Claims, 17 Drawing Sheets

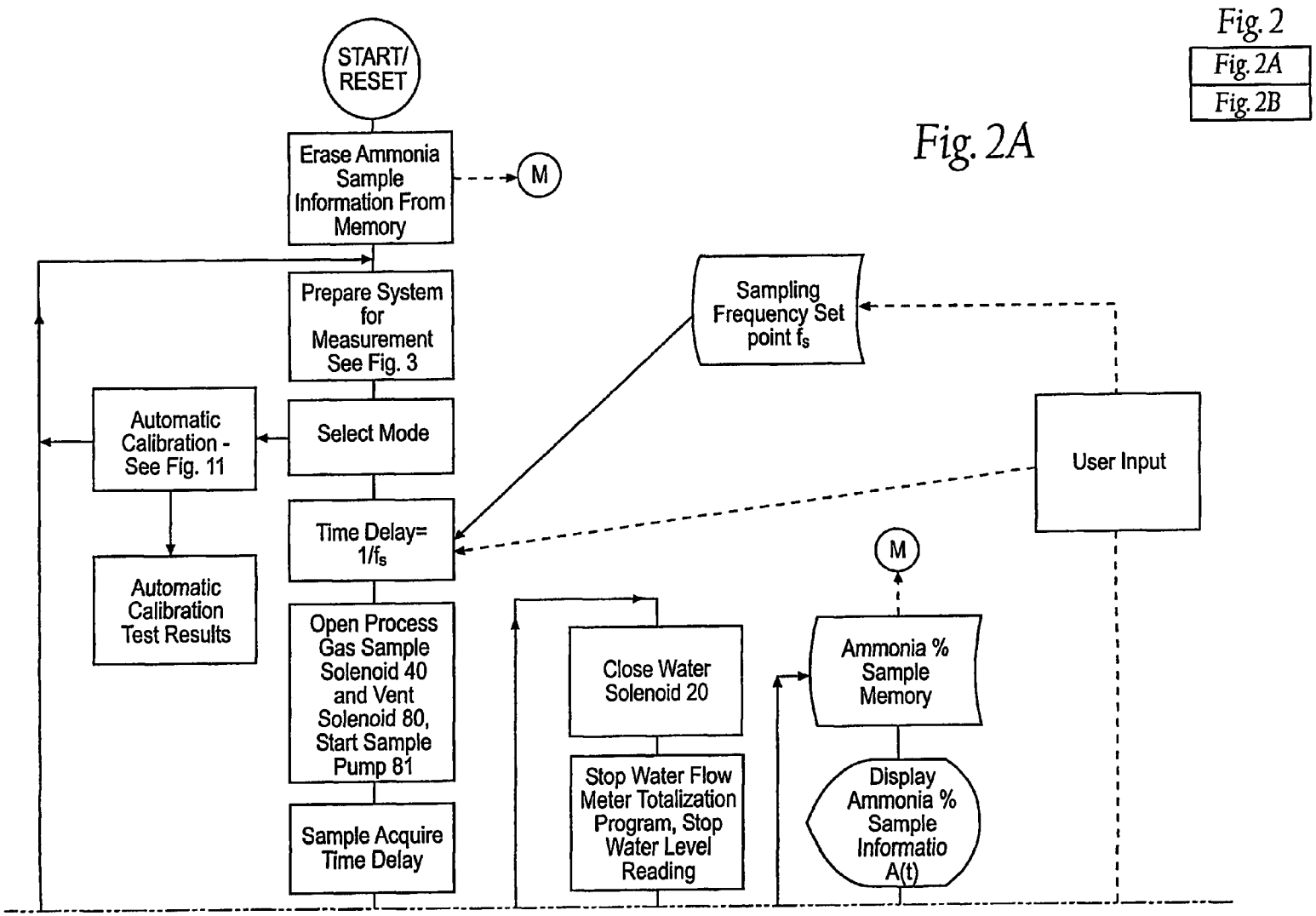
Fig. 2
Fig. 2A
Fig. 2B
Fig. 2A
START/ RESET
Erase Ammonia Sample Information From Memory
M
Prepare System for Measurement See Fig. 3
Select Mode
Automatic Calibration - See Fig. 11
Automatic Calibration Test Results
Sampling Frequency Set point $f_s$
Time Delay= $1/f_s$
Open Process Gas Sample Solenoid 40 and Vent Solenoid 80, Start Sample Pump 81
Sample Acquire Time Delay
User Input
M
Ammonia % Sample Memory
Display Ammonia % Sample Informatio A(t)
Close Water Solenoid 20
Stop Water Flow Meter Totalization Program, Stop Water Level Reading

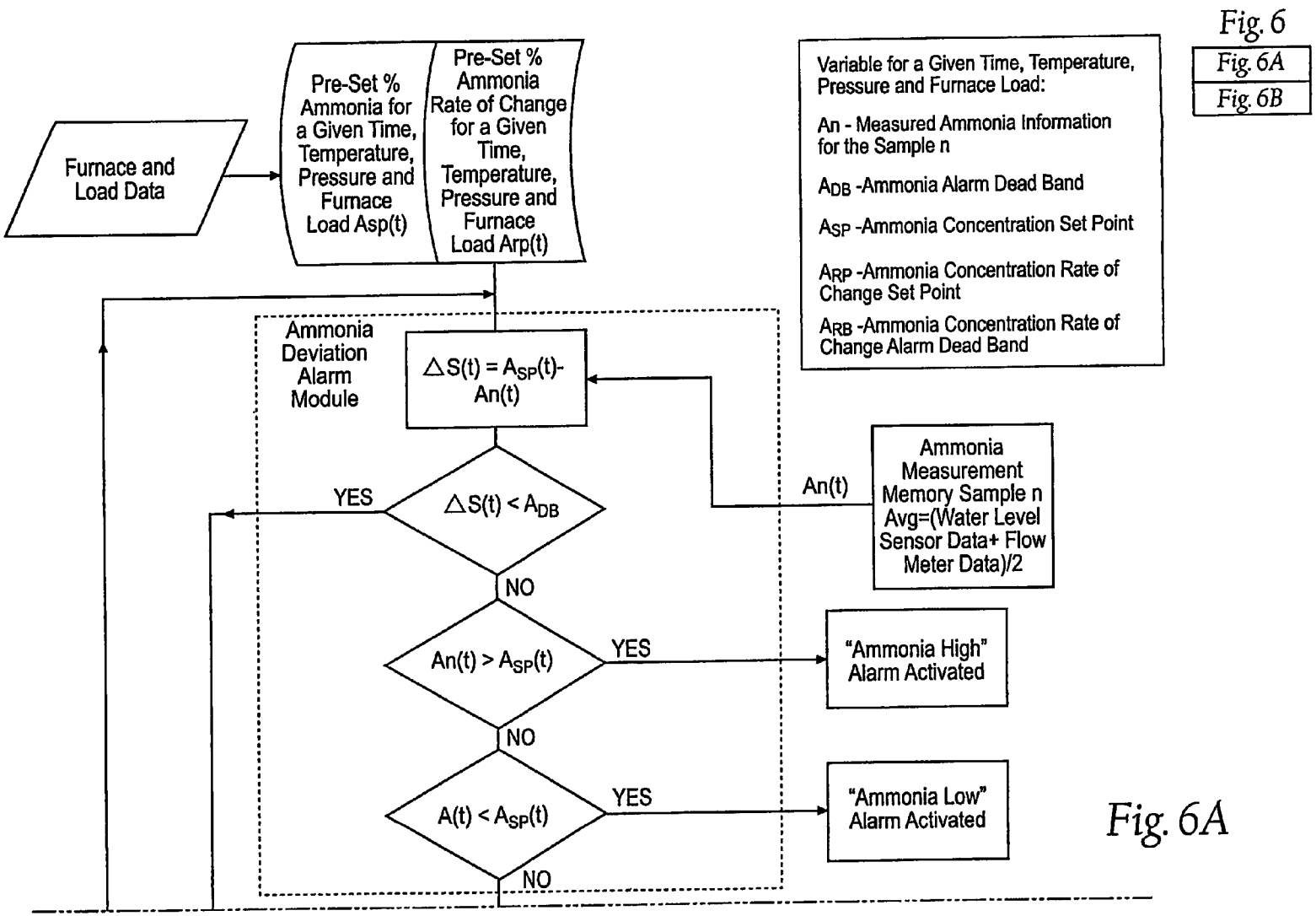
Fig. 6
Fig. 6A
Fig. 6B
Variable for a Given Time, Temperature, Pressure and Furnace Load:
An - Measured Ammonia Information for the Sample n
ADB -Ammonia Alarm Dead Band
ASP -Ammonia Concentration Set Point
ARP -Ammonia Concentration Rate of Change Set Point
ARB -Ammonia Concentration Rate of Change Alarm Dead Band
Ammonia Measurement Memory Sample n Avg=(Water Level Sensor Data+ Flow Meter Data)/2
An(t)
"Ammonia High" Alarm Activated
"Ammonia Low" Alarm Activated
Pre-Set % Ammonia Rate of Change for a Given Time, Temperature, Pressure and Furnace Load Arp(t)
Pre-Set % Ammonia for a Given Time, Temperature, Pressure and Furnace Load Asp(t)
Furnace and Load Data
Ammonia Deviation Alarm Module
△S(t) = ASP(t)- An(t)
△S(t) < ADB
YES
NO
An(t) > ASP(t)
YES
NO
A(t) < ASP(t)
YES
NO

SYSTEMS AND METHODS FOR CONTROLLING HEAT TREATING ATMOSPHERES AND PROCESSES BASED UPON MEASUREMENT OF AMMONIA CONCENTRATION

RELATED APPLICATIONS

This patent application is a continuation of International Patent Application Serial No. PCT/US03/36057 filed 12 Nov. 2003, which claims the benefit of U.S. Provisional Patent Application Ser. No. 60/425,530 filed 12 Nov. 2002.

BACKGROUND OF THE INVENTION

In heat-treating of solid ferrous alloys within a furnace, gas nitriding is one of the often-used processes to achieve high surface hardness, to improve fatigue life, and increase anti-galling properties. Nitriding is performed by placing metal parts in the furnace, heating the metal to a proper temperature between 495° C. and 565° C., and holding the metal in contact with a nitrogenous gas, typically anhydrous ammonia. Ammonia dissociation in the furnace atmosphere is critical for the quality of the heat treated parts, as discussed in Floe, U.S. Pat. No. 2,437,249, "Method of Nitriding", and Rose, et al., U.S. Pat. No. 4,264,380, "Nitride Casehardening Process and the Product Thereof." Nitriding capability of the nitriding atmosphere may also be expressed as nitriding potential, as suggested in "Aerospace Material Specification Standard AMS 2759/10". Nitriding Potential measurement requires the measurement of partial pressure of ammonia and the partial pressure of hydrogen as a result of dissociated ammonia in the furnace atmosphere exhaust. Gas nitrocarburizing processes such as described in Heminghous, U.S. Pat. No. 4,776,901, "Nitrocarburizing and nitriding process for hardening ferrous surfaces", also require ammonia gas dissociation in the furnace measurement.

Because ammonia dissociation information is so important, automatic means of measuring ammonia dissociation in a heat-treat atmospheres were developed and are being used. Those methods usually consist of photometry of ammonia in the infrared range while ammonia is still in gaseous form, or measurement of ammonia combustion on a catalyst thermal reaction.

The principal of infrared photometry is based on measurement of the intensity of infrared light transmitted, absorbed, or reflected from a gas sample, and compared with a reference light intensity. Such a process has many disadvantages, such as interference of other gasses in the mixture, drift of the instrument, and need of frequent calibration, thereby incorporating expensive certified gasses. One of the biggest obstacles of using infrared ammonia concentration measurement is the necessity to have extremely rigorous maintenance procedures in place to keep the optics and sensors clean.

Another automatic ammonia dissociation concentration measurement of a heat-treat atmosphere method involves determining the individual gas concentration in a mixture of gasses by a thermal reaction heat measurement, where the heat is generated by ammonia being burned on a catalyst. This approach is also difficult to perform reliably in a factory setting.

Another automatic ammonia dissociation measurement of a heat-treat atmosphere method involves determining the concentration of gasses that are a product of dissociated ammonia, such as hydrogen, and then calculating actual dissociation. This approach, however, also uses sensors that do not always endure the harsh factory environment.

Measurement of dissociated ammonia in the gas mixture is often done by sampling a predetermined amount of gas, then dissolving ammonia in the gas form into a liquid form, and determining the concentration of ammonia in solution. Such methods are typically manual operations, but Keil, et al., U.S. Pat. No. 5,801,296 "Process for automated measurement of ammonia content in a gas mixture," and Keil, et al., U.S. Pat. No. 5,767,383, "Apparatus for automated measurement of ammonia concentration in a gas mixture," disclose a method of automating ammonia contents measurement in the gas sample by dissolving ammonia into water. To reveal the amount of dissolved ammonia, the patented apparatus and process use a tubular-shaped measurement vessel and a technique to measure pressure created by a water column, or measuring the height of water column. However, the pressure transducer port is prone to water contamination resulting in an error in the sensed differential pressure and, therefore, an error in determining the ammonia concentration in a gas mixture. A number of measures to prevent water entrapment were taken. The methods described in the above patents include the steps of providing a fifth solenoid valve for draining the entrained water, and providing inlet ports located at exactly pre-set angles.

SUMMARY OF THE INVENTION

The present invention provides systems and methods for determining an ammonia content of an ammonia-based atmosphere. The systems and methods provide a measurement vessel. The systems and methods provide an ammonia-based atmosphere conveyed into the measurement vessel. The systems and methods provide water conveyed into the measurement vessel, with the water causing dissociation of ammonia from the atmosphere within the measurement vessel. The systems and methods measure a flow rate of water into the measurement vessel during the dissociation. The systems and methods determine the ammonia content in the atmosphere based, at least in part, upon the flow rate of water.

BRIEF DESCRIPTION OF THE DRAWINGS

FIGS. 2A and 2B show a diagrammatic view of a preferred flow chart showing the generation of control outputs, ammonia concentration information calculation, processing and storage, in a preferred implementation of ammonia concentration measurement and control system that embodies the features of the invention.

FIGS. 6A and 6B show a diagrammatic view of a preferred flow chart showing the alarm generation associated with the flow chart shown in FIGS. 2A and 2B.

DESCRIPTION OF PREFERRED EMBODIMENTS

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
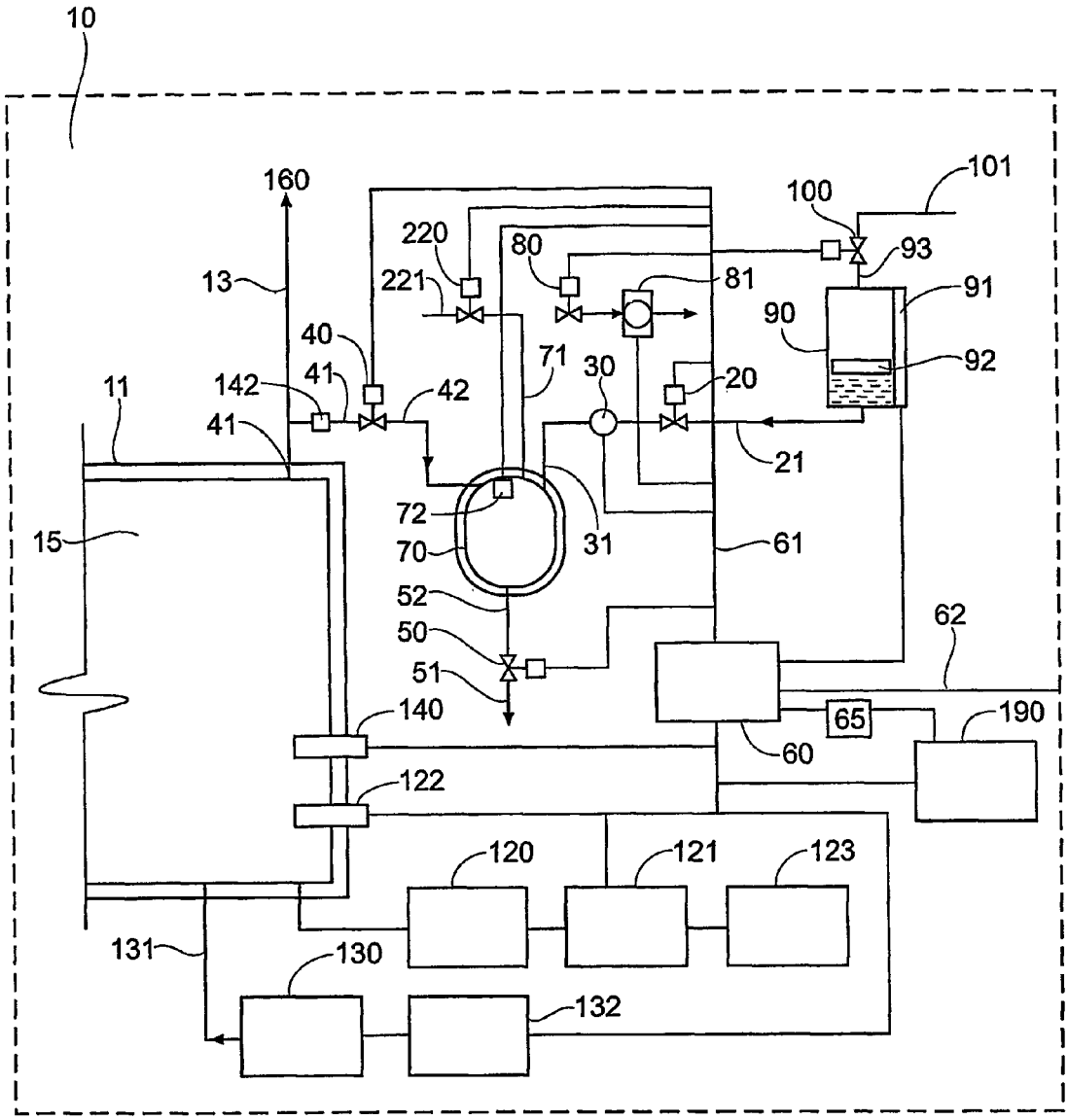
FIG. 1 is a diagrammatic view of ammonia concentration measurement and control system for a heat-treating furnace that embodies the features of the invention.

FIG. 1 represents a system 10 for measuring the atmosphere 15 of a heat treat furnace 11. The furnace 11 includes a source 130 of the preferred heat-treating atmosphere 15, which, through atmosphere supply line or lines 131, is passed into the furnace 11. The source 130 of the preferred heat-treating atmosphere 15 is controlled by a furnace gas flow controller 132, which adjusts gas flows based on an electric signal supplied to a final control element, such as a solenoid or motorized valve.

The furnace 11 also includes a heating source 120. A furnace temperature controller 121 controls the heating source 120. The furnace closed-loop temperature controller 121 receives the temperature information from the furnace thermocouple 122 and a temperature from a set point 123. The heating source 120 heats the inside of the furnace 11, and also the furnace atmosphere 15. Furnace 11 also includes an industry standard over-temperature safety control system, which is not shown.

The furnace 11 is a conventional batch-type furnace. For example, the furnace 11 may be one of the types of nitrocarburizing or nitriding furnaces shown in "ASM Metals Handbook, Heat Treating", Volume 4, pages 200-207, published by ASM International 1991.

The furnace's atmosphere gas mixture 15 actively impacts the surface treatment of the steel parts inside the furnace 11. The gas mixture in the furnace may contain air, air and ammonia, or ammonia in a mixture of gasses including nitrogen, and hydrogen. In the nitrocarburizing process, endothermic gas, or so-called "synthetic endothermic gas," is also present. A backpressure control device controls the furnace presure. Exhaust gas is treated or directly released to a safe location 160, which is typically a location for the exhaust gas to be burned off. The furnace atmosphere 15 is flammable and would be neutralized in the safe location 160 by an effluent burner. Some of the possible gas supply and exhaust methods are described "ASM Metals Handbook, Heat Treating", Volume 4 Heat Treating, pages 203-207, Published by ASM International 1991.

The system 10 includes a measurement vessel 70. Vessel 70 is equipped to receive the actual atmosphere 15 that exists in furnace 11. Measurement vessel 70 also is equipped with a water inlet line 31. Water is supplied from a constant low-pressure water vessel 91, through a water line 21, a solenoid 20 and a water flow meter 30. The flow meter 30 generates a signal that is converted by a controller, PLC, or computer 60 into an ammonia concentration value, expressed as percent residual ammonia, percent dissociated ammonia, or nitriding potential. Controller 60 also generates a signal that is used in a feedback loop to maintain a desired atmosphere 15 in the furnace 11.

Measurement vessel 70 also has a water discharge line 52, which is connected in series to a solenoid 50 that controls the discharge of the ammonia water solution to a safe location 51 outside of the closed-loop system where it may be discharged or recycled in any desired way. The safe location 51 and the safe location 160 previously discussed may be the same or different locations.

The measurement vessel 70 also has a gas inlet line 42. Furnace atmosphere 15 is pumped into the measurement vessel 70 by a sample line 41 or lines 41, through filter 142, and through solenoid 40. Another solenoid 80 is connected to a gas exhaust line 71 of the vessel 70. A sample pump 81 is connected to the outlet of the solenoid 80.

A vacuum created by the pump 81 draws in the furnace gas 15 and exhausts the gas 15 to a safe location 160. The flow path of the furnace gas 15 during the gas sampling process is as follows: gas inlet or sample line 41, filter 142, solenoid 40, vessel 70, exhaust line 71, solenoid 80, pump 81, to the safe location 160 as previously stated. A vent solenoid 220 connected to the exhaust line 71 controls the vessel venting.

Measurement vessel 70 further comprises a water level sensing device 72. Water sensing device 72 incorporates a water level switch or other water sensor commonly used in the industry. When the vessel 70 is filled with water to a known capacity, the water sensing device 72 is activated and sends an electrical signal to a controller 60. Furnace pressure sensor or thermocouple 122 also sends furnace pressure information to controller 60.

Water vessel 90 is partially filled with water through water supply line 93. Water flow is controlled by a solenoid 100, located between a pressurized water source 101 and the vessel 90. Vessel 90 is equipped with the water level measurement sensor 91, which receives water level information from a float 92.

The water sensing device 72, flow meter 80, pump 81, and all other solenoids are connected by individual wires, shown in simplified schematic as 61 to the controller, computer, or PLC 60.

The Measurement Apparatus

Figure 9:
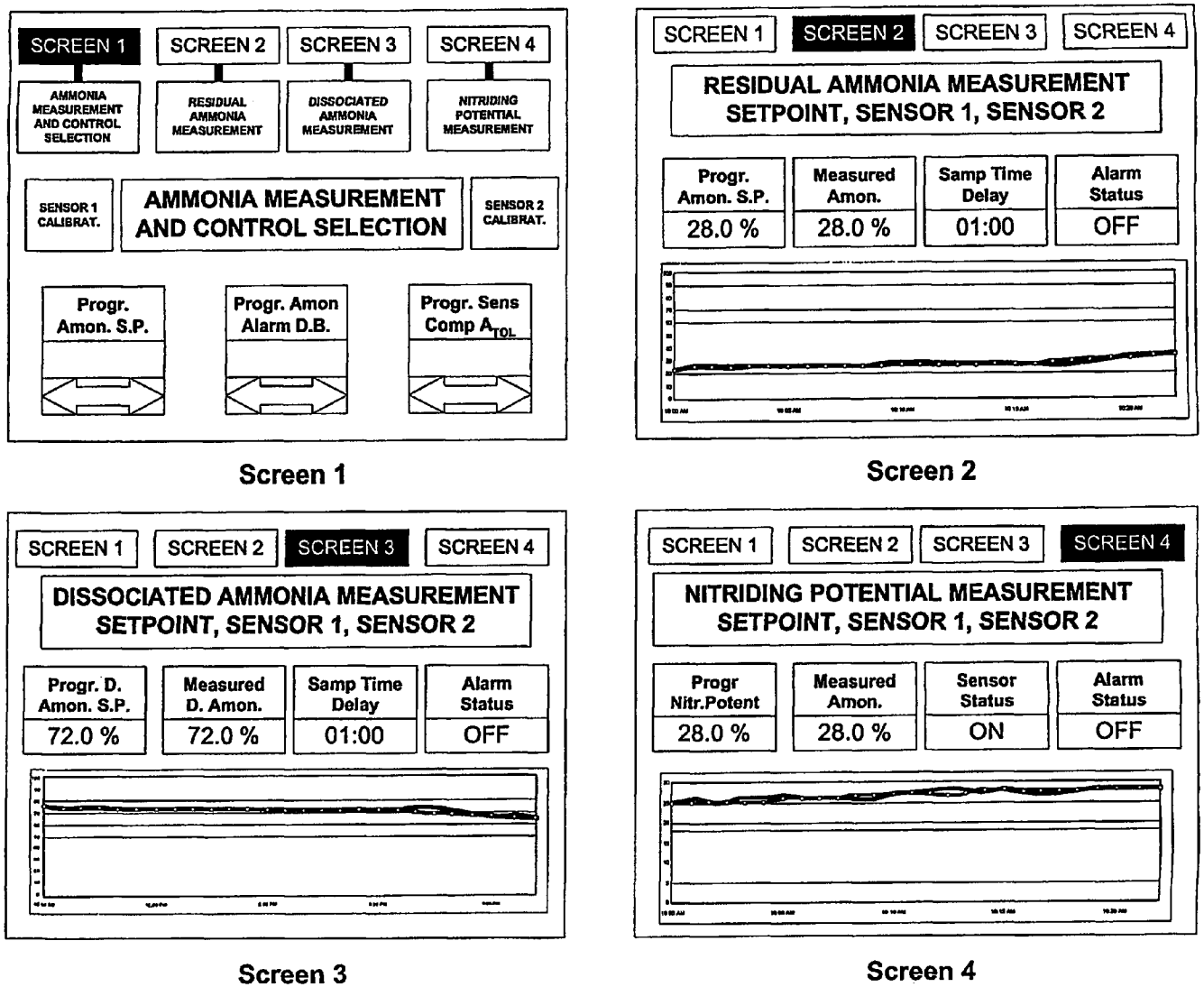
FIG. 9 is a diagrammatic view of the graphical user display information associated with the furnace gas concentration sensing system shown in FIG. 8.

Control and measurement of the ammonia content in the system is performed with the following steps:

a) Solenoid valves 40, 80, 20 are closed. Pump 81 is turned to an "off" position. The solenoid valves 50 and 120 are open, allowing water from the vessel 70 to drain to the safe location 51 as previously discussed. Solenoid valve 100 is opened letting pressurized water from the water source 101 flow to the water vessel 90. When the water vessel 90 is filled to a predetermined amount, preferably 95% capacity, solenoid 100 closes. The measurement sensor 91 precisely measures the water level in the water vessel 90, which is sent to the controller 60 and stored.

b) solenoid valves 220, 100, 50, 20 are closed. Pump 81 is turned to an "on" position. Solenoid valve 40 and solenoid valve 80 are now opened. Furnace atmosphere gas mixture 15 is supplied through the exhaust lines 41, through the filter 142, and then to the solenoid 40 and to the vessel 70. A gas mixture fills the vessel 70 and further travels through the line 71, to the solenoid valve 80 onto the pump 81, where it is vented to the safe location 160.

c) Solenoid valves 220, 100, 80, 50, 40 are closed. Pump 81 is turned back to the "off" position. A water totalization and level measurement program in the controller 60 is activated. The program receives and analyzes flow information from the flow meter 30. The program also receives water level information from the measurement sensor 91 and compares the information with information from the flow meter 30. Solenoid valve 20 is opened, which allows low-pressure water from the vessel 90 to flow to the vessel 70. When solenoid valve 20 is opened and water starts to flow to vessel 70, the flow meter 30 measures the flowing water volume. The water will flow into vessel 70 and will dissolve the water-soluble gas-ammonia, present in the gas mixture. The water level in the vessel 90 will drop, as water fills the vessel 70 and solenoid 100 closes the water supply 93. The water level change effects the float 92, whose position is measured by 91 and sent as an electrical signal to the controller 60.

d) Solenoid valves 220, 100, 80, 50, 40 are still closed, and pump 81 is still in the "off" position. The water flow will stop when the water-soluble gas in vessel 70 is completely dissolved. At that time the measurement of the water flow through the flow meter 30 will stop, and the water level in the vessel 90 will stabilize. The amount of water metered by flow meter 30 flowing from vessel 90 through solenoid 20 is directly proportional to the volume that was previously occupied by the water-soluble gas, or ammonia, in the vessel 70. This is also proportional to amount of ammonia that was present in the gas mixture in the furnace atmosphere 15. After a time delay sufficient to allow full gas dissolution in the water, approximately 20-45 seconds, the solenoid valve 20 will close. Microprocessor 60 will compare the change in water level with the stored information of the water totalization program. The total volume of water that evacuated vessel 90 and flowed through the meter 30 is converted to an amount of residual ammonia in atmosphere 15, expressed as a percent. Based on the process needs and the gasses present in atmosphere 15, the ammonia information can be expressed as ammonia dissociation, or nitriding potential. The calculated value is stored until the next measurement sequence and is also provided as a continuous analog or digital signal output for additional furnace atmosphere recording, monitoring, or control system and is displayed on a User Interface 190 for the operator of the system to view. Examples of the User Interface 190 are shown in FIG. 9.

The measured information is also used to generate the alarms for the operator, if the deviation of the ammonia concentration, ammonia dissociation, or atmosphere nitriding potential value from a preset required value is greater than permissible. Multiple sample values may also be stored and compared with each other to measure the atmosphere ammonia concentration change rate and generate the alarm if the rate of change is outside the acceptable limits. The measured information is also used to generate a control signal, which is sent to flow controller 132, thereby adjusting the furnace atmosphere gas flows from the atmosphere source 130.

The apparatus may then repeat the steps a) through d) to continuously monitor the system 10. The time delay between measurements is adjustable, allowing continuous measurement or repeated measurement at a pre-set time intervals.

The preferred type of solenoid valve 50 is normally an open valve. Solenoid 50 can be left in the open or non-energized mode between the measurement sequences.

The microprocessor-based controller, process computer, or programmable logic controller 60 controls the sequence described above. Electrical relay control outputs control all solenoids connected to the controller 60. The electrical inputs of the controller 60 are connected to the water level switch 72, the water level sensor 91, and the flow meter 30.

Percent Ammonia Value Calculation

Flow information is totalized, processed and converted to the residual ammonia value, dissociated ammonia value, or nitriding potential in the measured gas mixture. The calculations are as follows:

Data from Vessel 90:

$$A_{r1}=((L_1-L_2)-\Delta L(0\%)\times 100/\Delta L(100\%)$$

$$\Delta L(0\%)=L_1-L(0\%)$$

$$\Delta L(100\%)=L_1-L(100\%)$$

Where:

$A_{r1}$—Reading of residual ammonia in the furnace atmosphere, expressed in percent.

$L_1$—Electrical signal value, representing water level in vessel 90 before ammonia sample in vessel 70 was processed and dissolved in water.

$L_2$—Electrical signal value, representing water level in vessel 90 after ammonia sample in vessel 70 was processed and dissolved in water.

ΔL(0%)—Electrical signal, representing water level difference in vessel 90 before and after gas sample containing 0% ammonia gas concentration was processed in vessel 70.

ΔL(100%)—Electrical signal, representing water level difference in vessel 90 before and after gas sample containing 100% ammonia gas concentration was processed in vessel 70.

L(0%)—Electrical signal, representing water level in vessel 90 after gas sample containing 0% residual ammonia gas concentration was processed in vessel 70.

L(100%)—Electrical signal, representing water level in vessel 90 after gas sample containing 100% residual ammonia gas concentration was processed in vessel 70.

Data from Flow Meter 30:

$$A_{r2}=((V_m)-V(0\%)\times 100/V_p(100\%)$$

Where:

$A_{r2}$—Reading of residual ammonia in the furnace atmosphere, expressed in percent.

$V_m$—water volume in liters, that flows from vessel 90 to vessel 70 and is measured by a flow meter 30 during gas sample processing in vessel 70 by dissolving ammonia in water.

V(0%)—water volume, in liters, that flows from vessel 90 to vessel 70 when the gas sample in vessel 70 has 0% residual ammonia.

V(100%)—water volume, in liters, that flows from vessel 90 to vessel 70 when the gas sample in vessel 70 has 100% residual ammonia.

When residual ammonia in vessel 70 representing furnace atmosphere 15 is known, it is also possible to calculate the dissociated ammonia value, expressed in percent.

Data from Vessel 90:

$$A_{d1}=100\%-A_{r1}$$

Where:

$A_{d1}$—Reading of dissociated ammonia in the furnace atmosphere, expressed in percent.

$A_{r1}$—Reading of residual ammonia in the furnace atmosphere, expressed in percent.

From Flow Meter 30 Data:

$$A_{d2}=100\%-A_{r2}$$

Where:

$A_{d2}$—Reading of dissociated ammonia in the furnace atmosphere, expressed in percent.

$A_{r2}$—Reading of residual ammonia in the furnace atmosphere, expressed in percent.

Using the measured ammonia information, and when partial pressure, or percent hydrogen in the furnace atmosphere is known, it is possible to calculate the nitriding potential of the furnace atmosphere according to the formula:

$$K_n = \frac{P_{NH3}}{(P_{H2})^{3/2}}$$

where $P_{NH3}$—partial pressure of ammonia in the atmosphere $P_{H2}$—partial pressure of hydrogen in the atmosphere To achieve high measurement accuracy, various water level and flow measurement instruments may be used. The preferred embodiment utilizes a magnetostrictive water level measurement and a high-precision turbine flow meter with pulse output. Other water level sensing methods may also be used to measure water level, including weighing methods using a pressure transducer. Also, the water flow measurement may be carried out with different flow metering devices, such as a turbine with pulse output.

In the case of turbine flow meter with pulse output, the manufacturer provides flow meter calibration specifications as pulses per standard water liter (Pspec/l). Then measured water volume in liters is calculated as:

$$V_{measur}=P_{measured}/P_{spec}/l$$

Where:

$P_{measured}$—total number of pulses that a turbine flow meter sends to the controller 60 as water flows from vessel 90 to vessel 70 in step c) above.

Figure 12A:
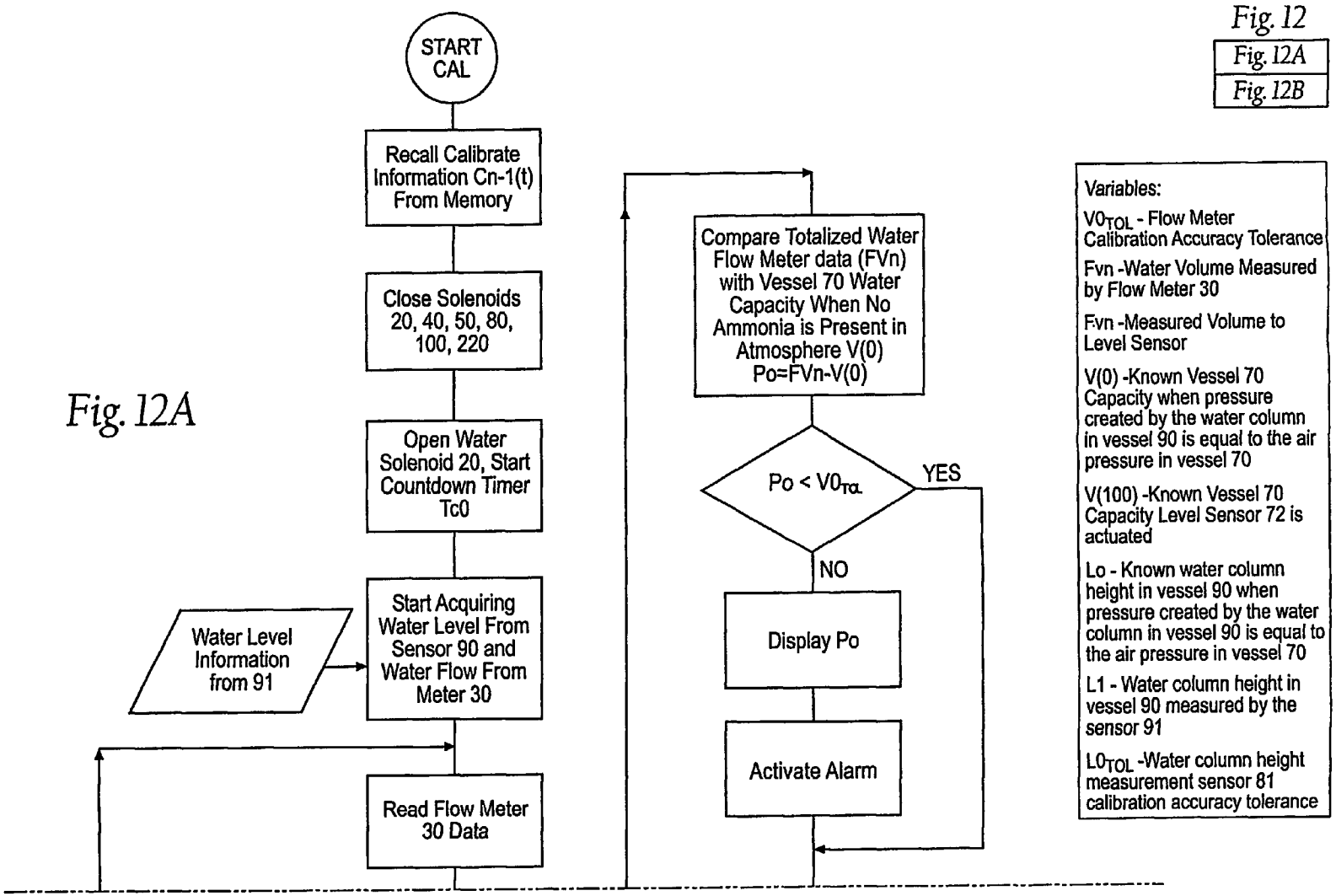
FIGS. 12A and 12B are diagrammatic views of a preferred flow chart showing the automatic calibration program of the ammonia concentration sensing and control system.
Figure 12B:
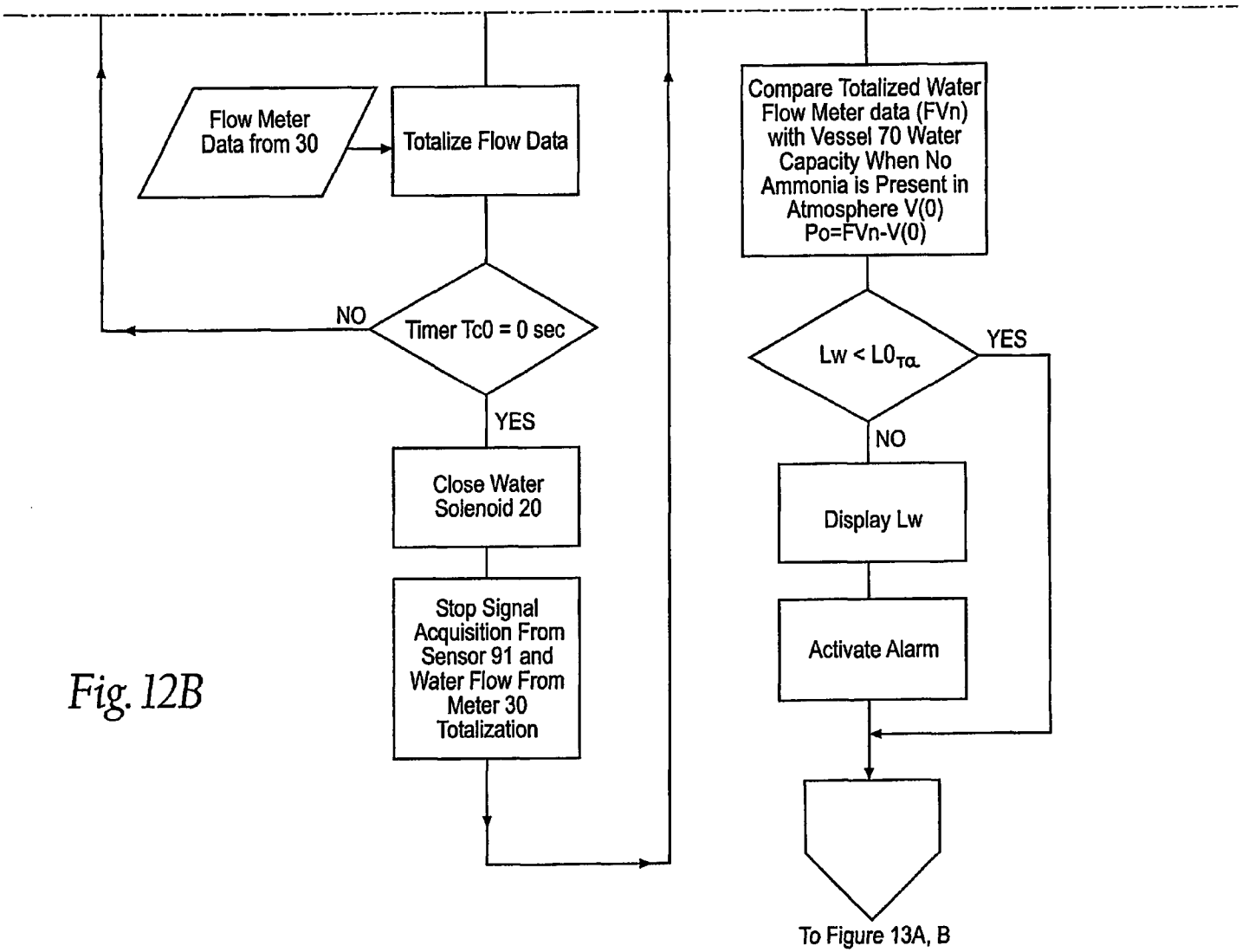
Figure 13A:
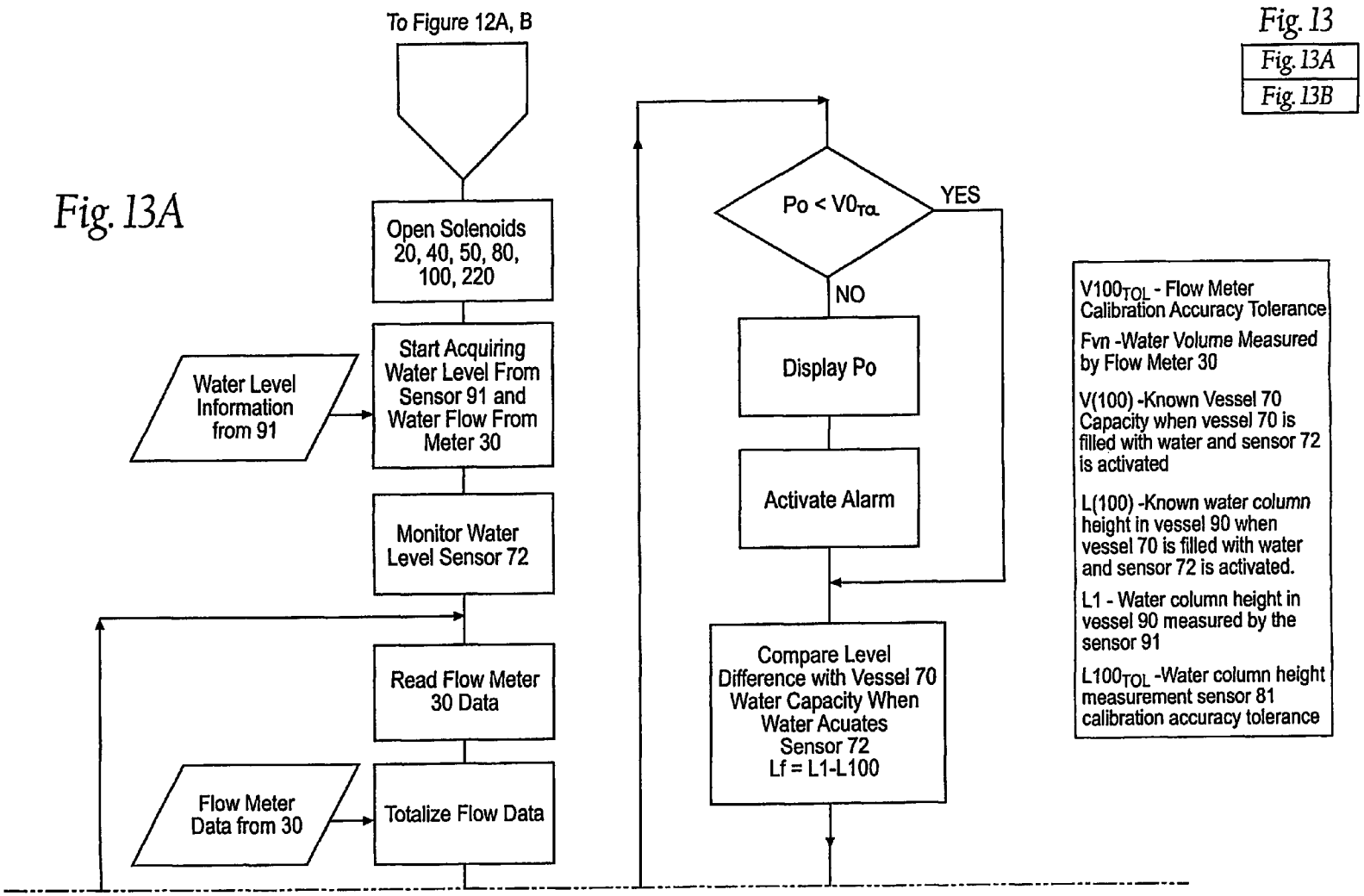
FIGS. 13A and 13B are diagrammatic views of a continuation of the preferred flow chart shown in FIGS. 12A and 12B showing the automatic calibration program of the ammonia concentration sensing and control system.
Figure 13B:
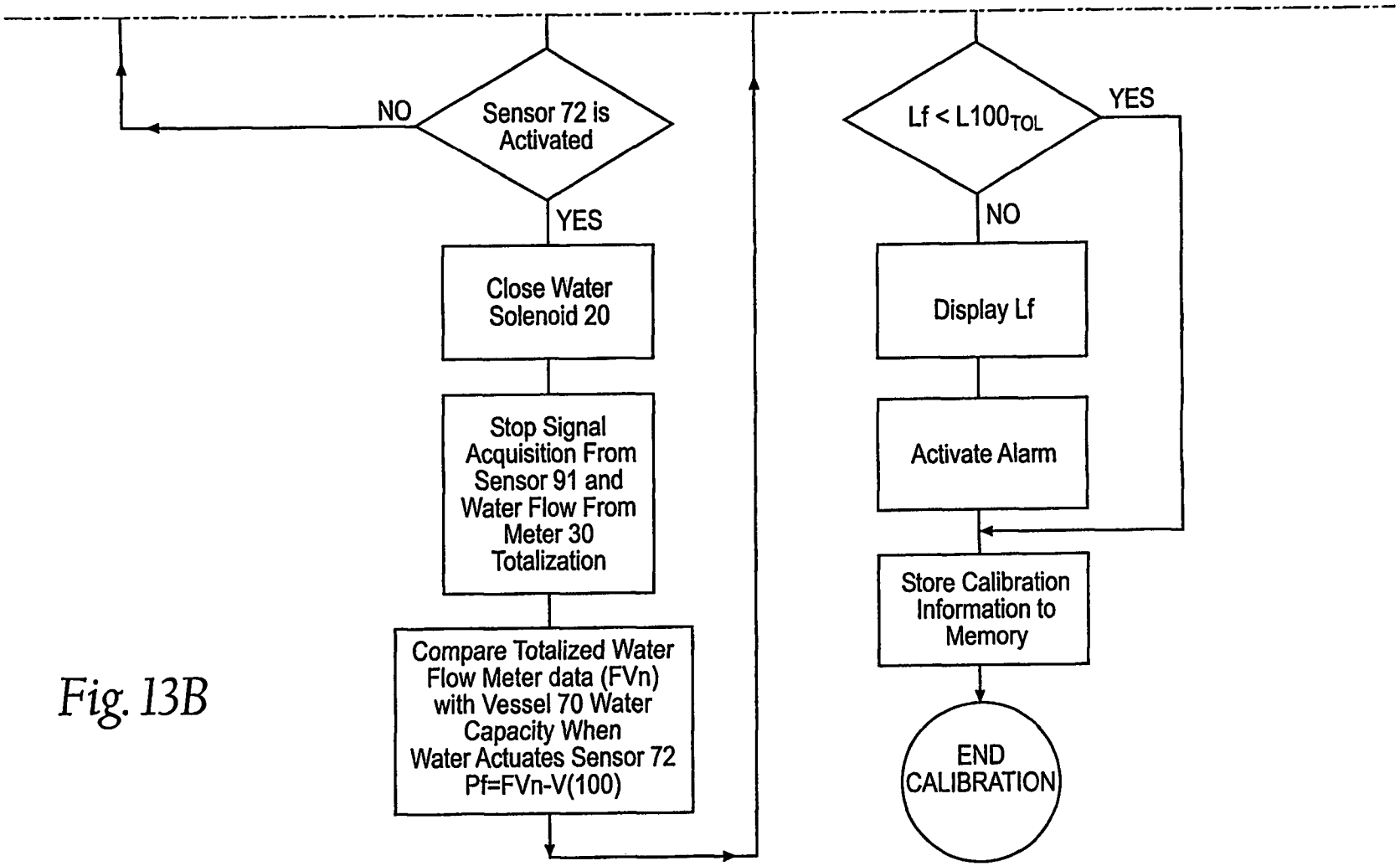

Vessel 90 data and flow meter 30 data are compared for increased measurement reliability. The comparison algorithm is shown in FIGS. 12A and 12B. It is also possible to utilize only one of the water measurement techniques to make the measurement system more economical.

System control algorithm maybe programmed in the memory of the programmable logic controller or process computer 60. Embedded microprocessor with suitable number of inputs and outputs may also be used to execute the algorithm.

Figure 4:
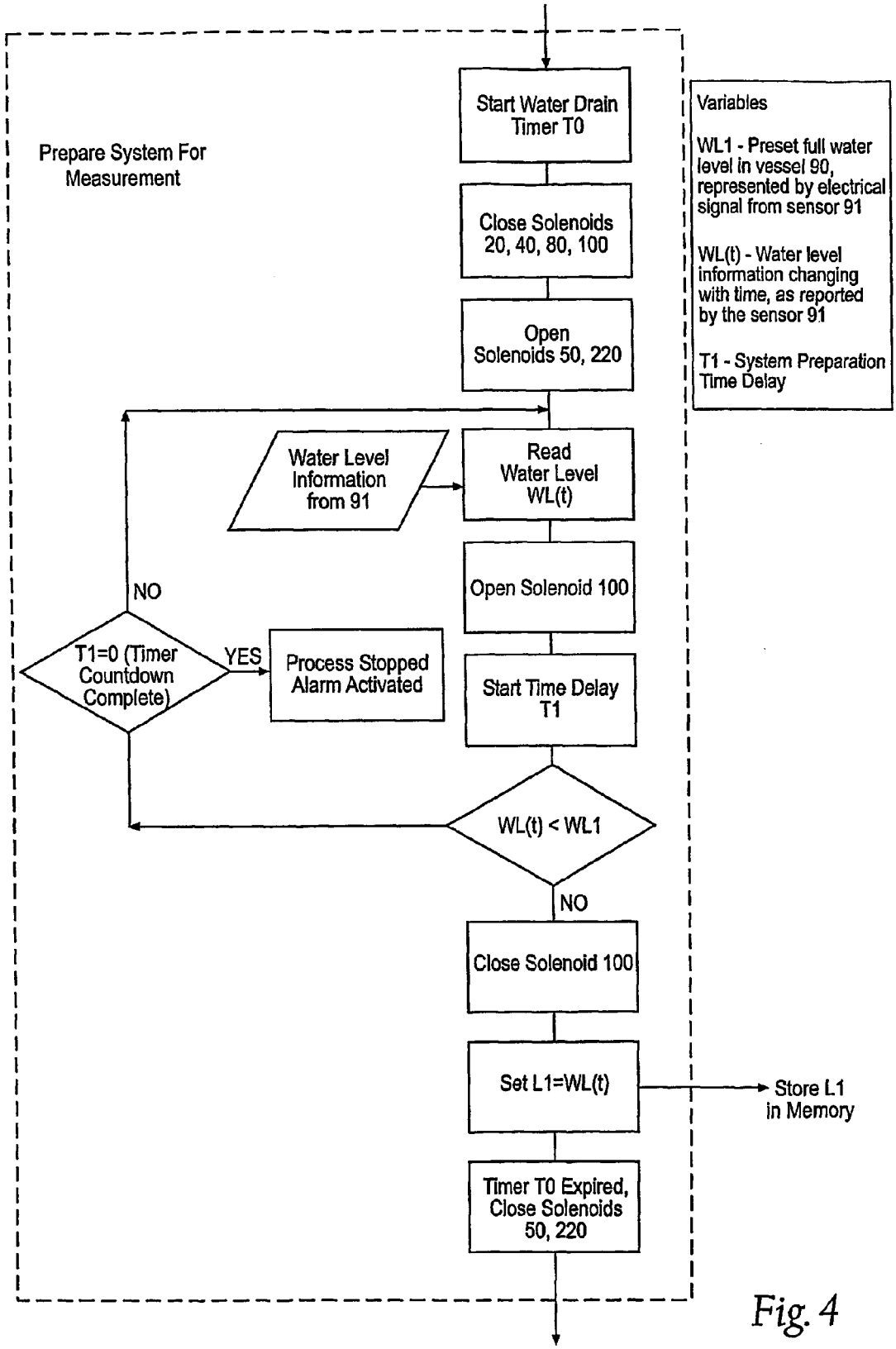
FIG. 4 is a diagrammatic view of a preferred flow chart showing the system preparation for the measurement associated with the flow chart shown in FIGS. 2A and 2B.

Ammonia concentration value is stored in the memory of the controller 60 between samples, as shown in FIG. 4, in order to enable easy interpretation of furnace atmosphere information by the operator and allow continuous atmosphere control.

It is accepted that the use of two water measurement methods linked within the system to monitor the ammonia concentration of the furnace. atmosphere will improve accuracy and reliability and will predict sensor failure. However, if heat-treating operations require very precise control of the furnace conditions, the system can use more than two methods to monitor water levels and measure the resulting ammonia concentration, where two or more sensing methods use the same technology for greater redundancy, zero down time, and a more fail safe operation.

The ammonia concentration measurement method is based on the assumption that the furnace gas mixture containing ammonia gas is being processed in the vessel 70 at a constant temperature. If furnace gas temperature in vessel 70 varies, a correction factor has to be applied based on an Ammonia Solubility Curve ("Air Liquide Ammonia Data Sheet", Air Liquide, Paris, France). Measuring the temperature of the vessel 70 and adjusting the ammonia concentration or dissociation calculation by a factor from the Ammonia Solubility Curve for the measured temperature may execute automatic correction for the process.

Sensor Alarm Module

FIG. 1 shows alarm module 65 connected to the controller 60. Process alarms are used to inform the operator about unsafe conditions or potential process quality problems. Ammonia concentration and rate of change alarms contribute the safety of the process and quality of the treated steel parts and help prevent quality defects caused by the incorrect amount of ammonia in the furnace atmosphere.

Figure 2B:
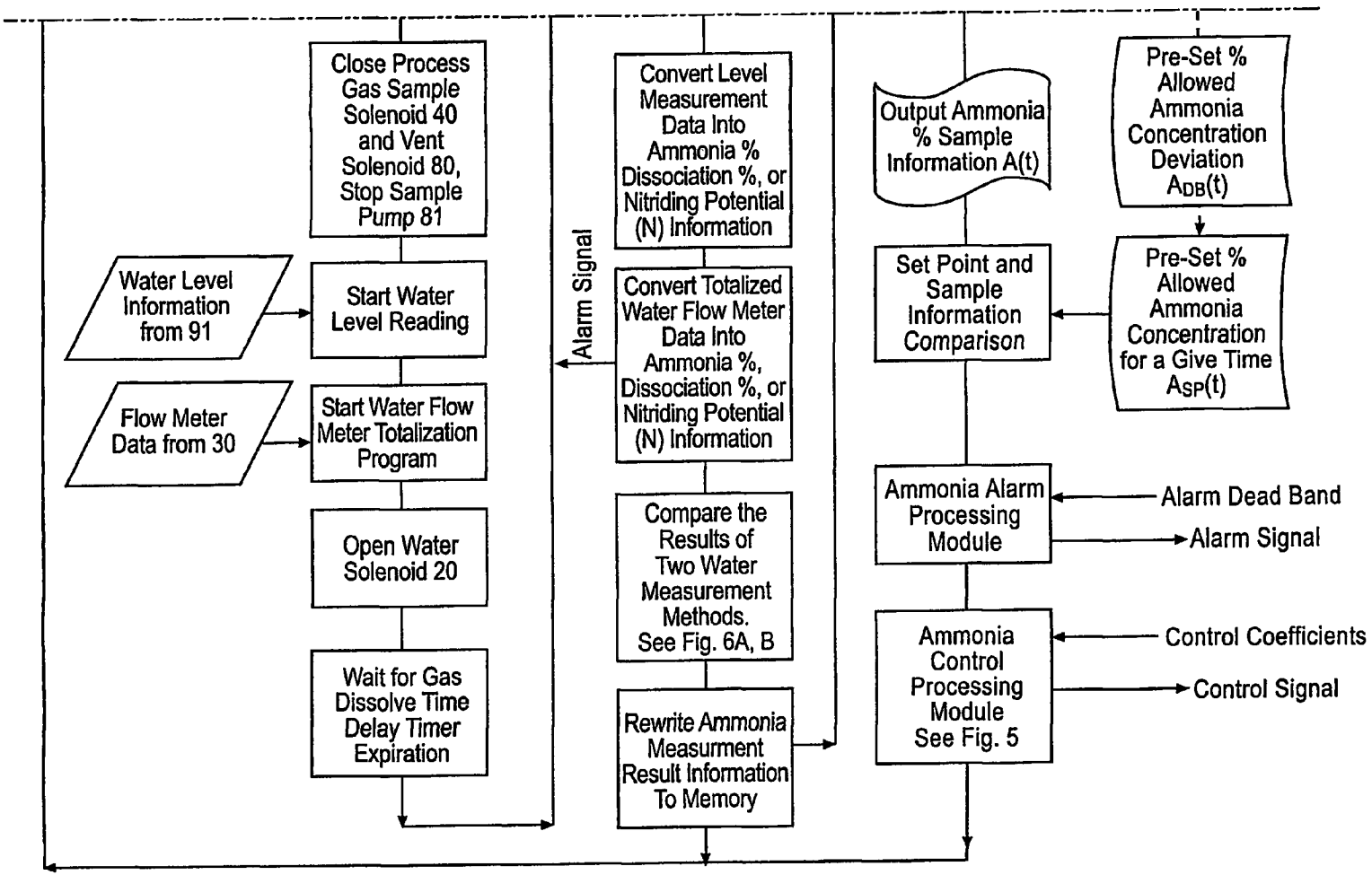
Figure 5:
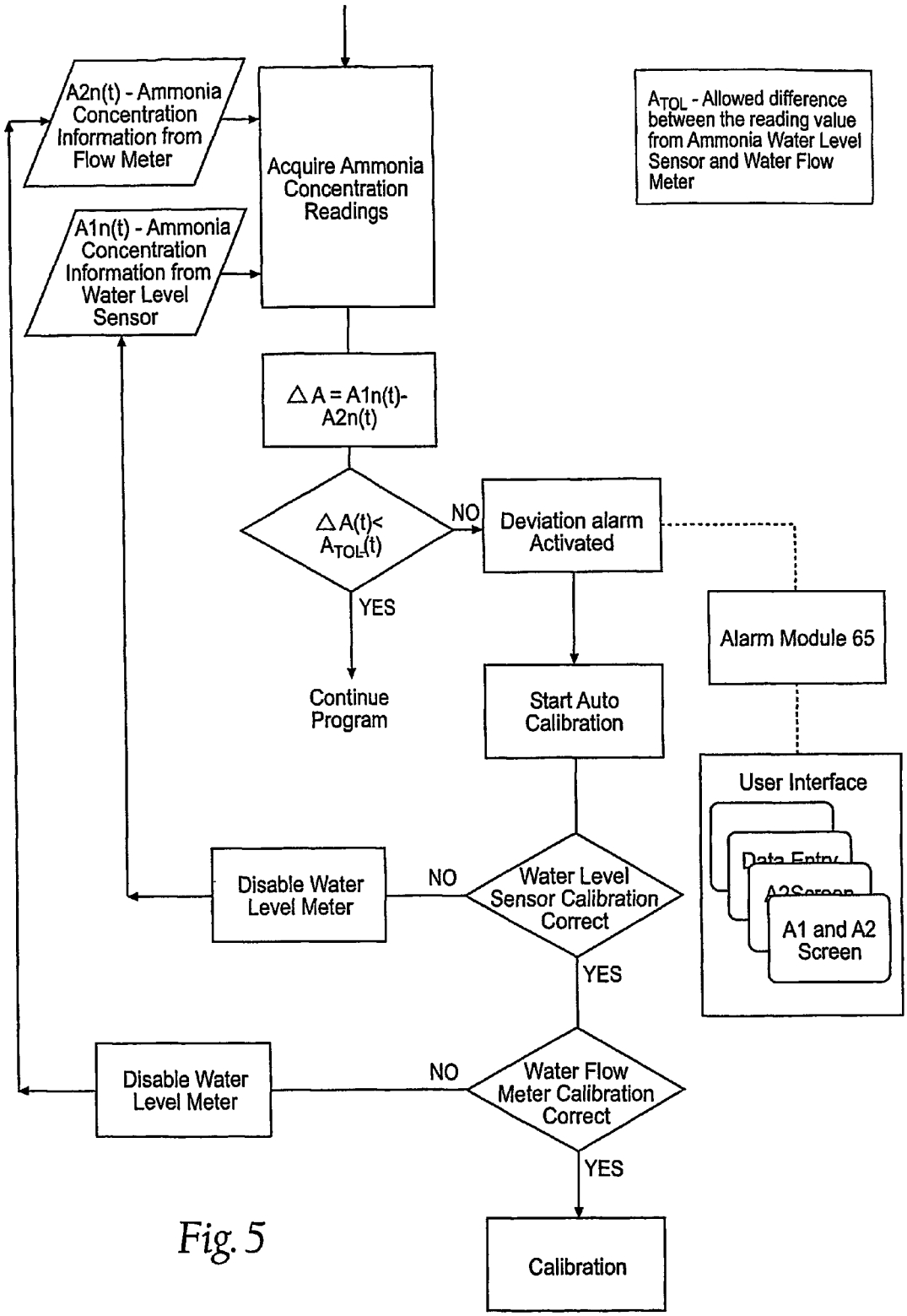
FIG. 5 is a diagrammatic view of a preferred flow chart showing the ammonia measurement result comparison assuring high measurement reliability associated with the flow chart shown in FIGS. 2A and 2B.
Figure 6B:
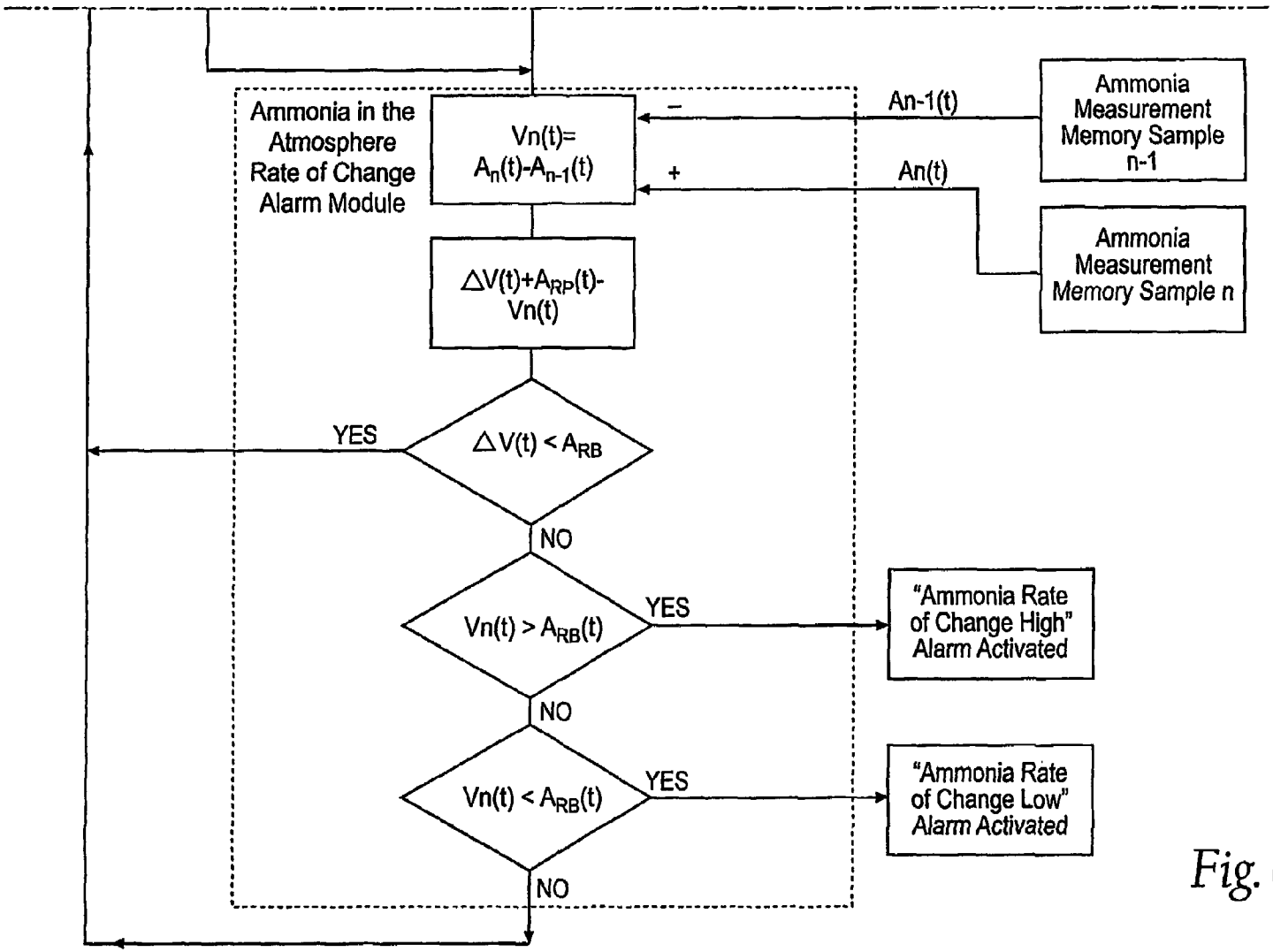

FIG. 5 is a flow chart comparing the ammonia measurement results to assure high measurement reliability associated with the flow chart in FIGS. 2A and 2B. FIGS. 6A and 6B is a flow chart showing the alarm generation system associated with the flow chart shown in FIGS. 2A and 2B.

Figure 3:
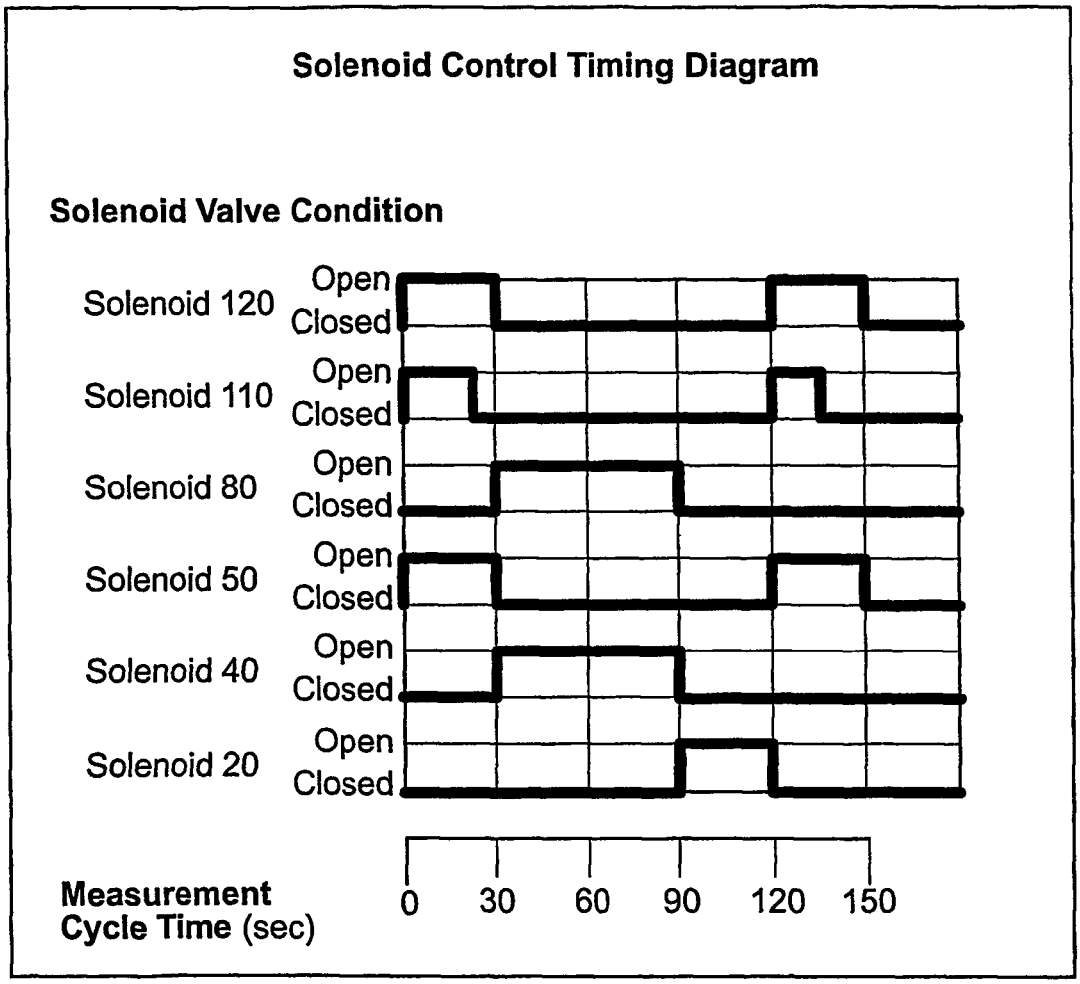
FIG. 3 is a graph of the preferred solenoid condition vs. time associated with the flow chart shown in FIGS. 2A and 2B.

Controller 60 is connected to a visual, and/or audio alarm, such as a telephone pager or mobile phone alarm 65. Interface 190 allows a user to preset desired process parameters required for the process. Interface 190 also allows deviations, or alarm threshold values, to be preset. The alarm 65 and the interface 190 may be integrated as a single device or arranged as separate devices. The desired parameters are stored in controller 60 memory and compared with the measured ammonia concentration information as shown in FIG. 3C. If the difference between desired and measured ammonia concentration information or process atmosphere rate of change information exceeds preset values, the alarm or alarms 65 will be activated based on the information transmitted from the controller 60 to the alarm outputs 190. It should be noted, that one or more electrical contacts may be used to send digital or analog high/low alarm signal to corresponding visual, audible, or remote notification alarms.

The Feedback Control System

Information from ammonia sensor can be used to control the furnace atmosphere 15. A furnace atmosphere controller, either separate or integrated into the system, contributes to the safety of the process and quality of the treated steel parts and helps prevent quality defects caused by the incorrect amount of ammonia in the furnace atmosphere.

Referring to FIG. 1, a diagrammatic view of an ammonia concentration measurement sensor and control system for a heat-treating furnace embodying the features of the present invention is shown. FIGS. 2A AND 2B. is a flow chart showing the generation of control outputs, and the ammonia concentration information calculation, processing and storage, in a preferred implementation of the system associated with FIG. 1. Furnace gas supply control 132 can utilize flow control elements, such as automatic valves that are in-line with the ammonia gas feed and the ammonia dissociator. The ammonia dissociator dissociates the ammonia before the ammonia is introduced in the furnace, as described in "ASM Metals Handbook, Heat Treating", Volume 4, pages 204-205, published by ASM International 1991.

The preferred embodiment for a final control element is a remotely controller needle valve. Different control element can also be used, such as any other type of a motorized valve, such as comprised of an actuator, or needle or butterfly valve, or one or more control solenoids, opening calibrated orifices or operating in a time-proportional manner. All control elements are widely used in the industry and can be selected based on the specific furnace 11 design.

The user interface 190 is electrically coupled to the controller 60, which stores desired ammonia concentration information set points for a given part and processing times in its memory.

Figure 7:
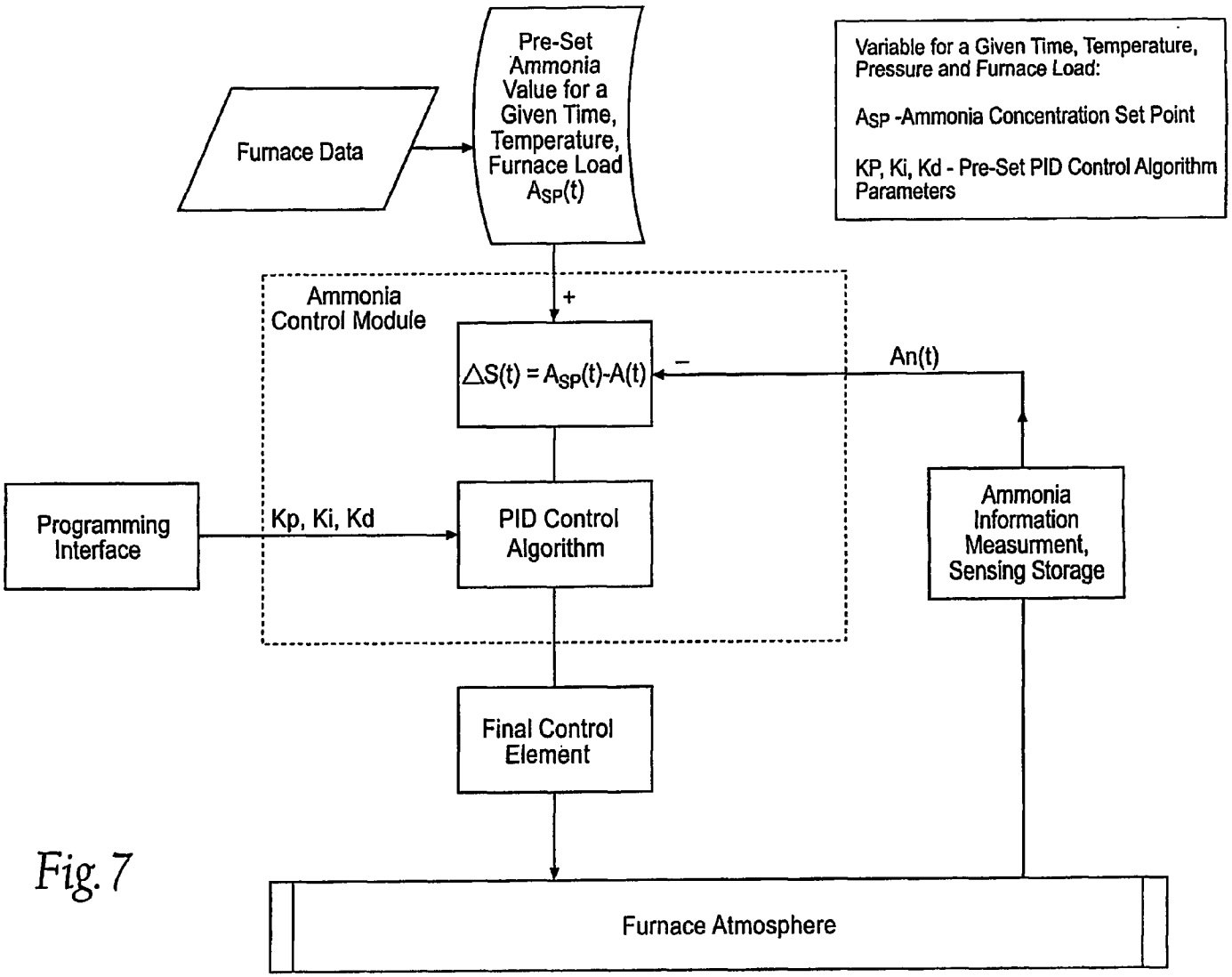
FIG. 7 is a diagrammatic view of a preferred flow chart showing the feedback closed loop ammonia control system associated with the flow chart shown in FIGS. 2A and 2B.

FIG. 7 is a preferred flow chart showing the feedback closed loop ammonia control system associated with the flow chart shown in FIGS. 2A and 2B.

Multiple Sensor System

Improved process control accuracy can be achieved by combining ammonia concentration measurements using the present invention, with the results of ammonia concentration or another gas concentration, such as hydrogen or oxygen, based on different sensing technology. Measurement results can be combined or compared and displayed for the operator. Information from multiple measurement systems can also be used to control furnace gas flow and to generate the process alarms if measured gas concentration deviates from the preset value.

Figure 8:
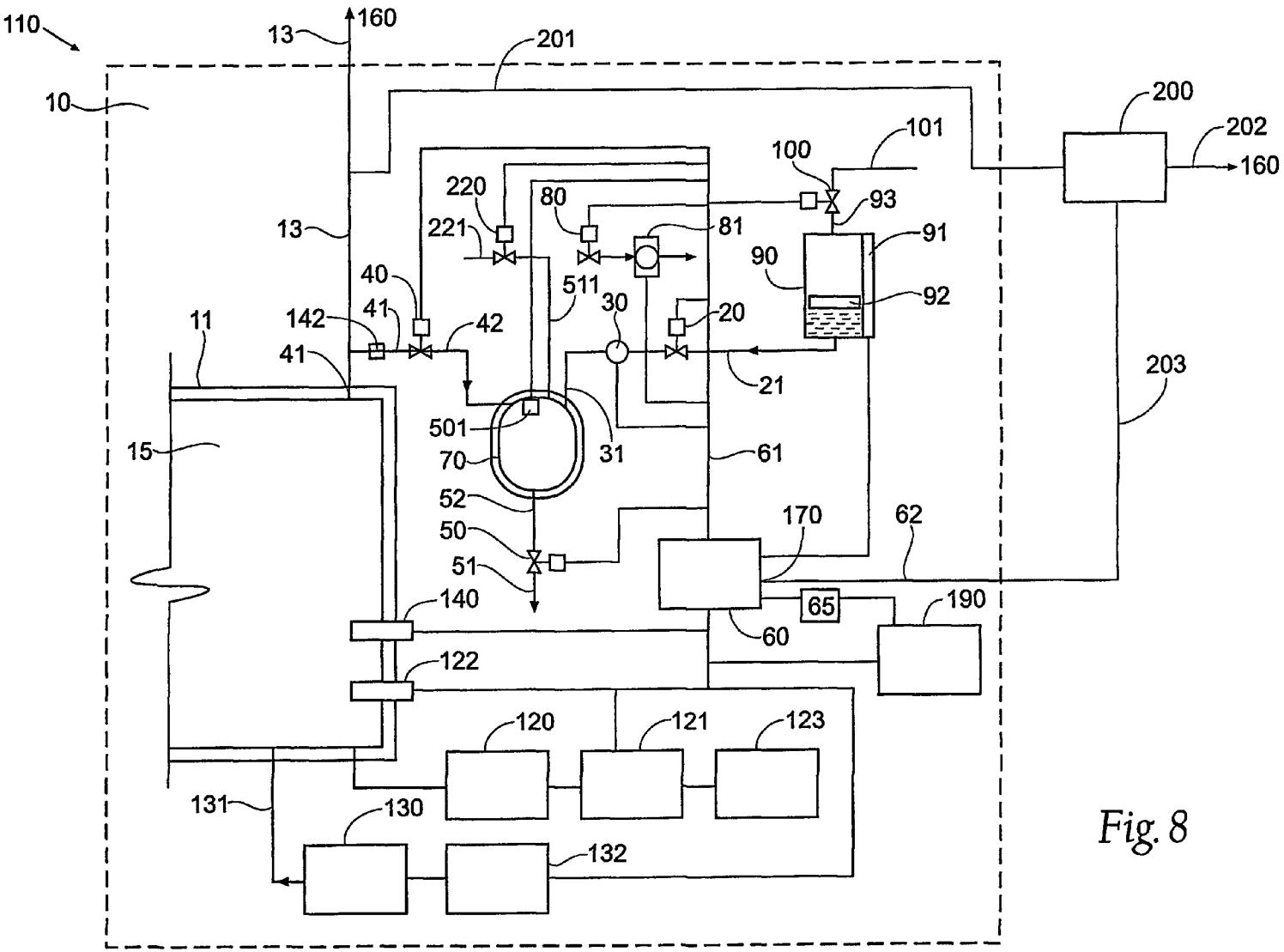
FIG. 8 is a diagrammatic view of the furnace gas concentration sensing system for a heat-treating furnace incorporating multiple sensors.

FIG. 8 shows a furnace gas sensing and control system 110. The system 110 comprises an apparatus 10, which measures the ammonia concentration of furnace atmosphere 15. The concentration measurement is based on the principle of ammonia dissolution in water, and employs an ammonia, hydrogen, oxygen, carbon monoxide or carbon dioxide gas sensing apparatus 200, which is based on the supplementary method used in the industry.

The furnace gas sensing apparatus 200 receives process atmosphere 15 by line 201. After the furnace gas sensing apparatus 200 measures the ammonia gas concentration of the atmosphere 15, gas is exhausted to the safe location 160. The exhaust gases are the by-products of the heat-treating atmosphere 15 from the nitriding or nitrocarburizing processes, such as hydrogen, nitrogen, carbon monoxide and carbon dioxide. Controller 60. receives information from sensing apparatus 200 and executes the ammonia gas measurement and control algorithms, described above and shown in FIGS. 2A and 2B and FIG. 3.

The output 203 of the furnace gas sensing apparatus 200 is electrically coupled to the input 62 of the controller 60.

User interface 190 is electrically coupled to the controller 60 and is used to display and enter set-points, deviation values, alarms, furnace loads, real time and historical ammonia dissociation information.

Calculating the ammonia concentration provided by the other furnace gas sensors can further increase reliability of the ammonia concentration measurement in the furnace atmosphere. It is also possible to use the predictive algorithms used in automatic control systems to determine which sensor information is more reliable.

FIG. 9 is a diagrammatic view of a graphical user display relating information associated with the furnace gas concentration sensing system shown in FIG. 8. A touch-sensitive display can be utilized for selection between the different screens shown in FIG. 9. Mechanical switch can also be used to select between the screens, or a simpler numeric or alphanumeric display can be used to enter and display the information shown in FIG. 9.

Ammonia Dissociator Atmosphere Measurement System

An ammonia dissociator is used in heat-treating processes, such as nitriding, annealing and brazing, especially when it is important that ammonia flowing to a heat-treating process should be fully dissociated. Presently, ammonia dissociators are controlled by monitoring of the dissociation temperature, which is based on the assumption that at the dissociation temperature range, 1800°-1850° F., ammonia gas will be fully-dissociated.

Figure 10:
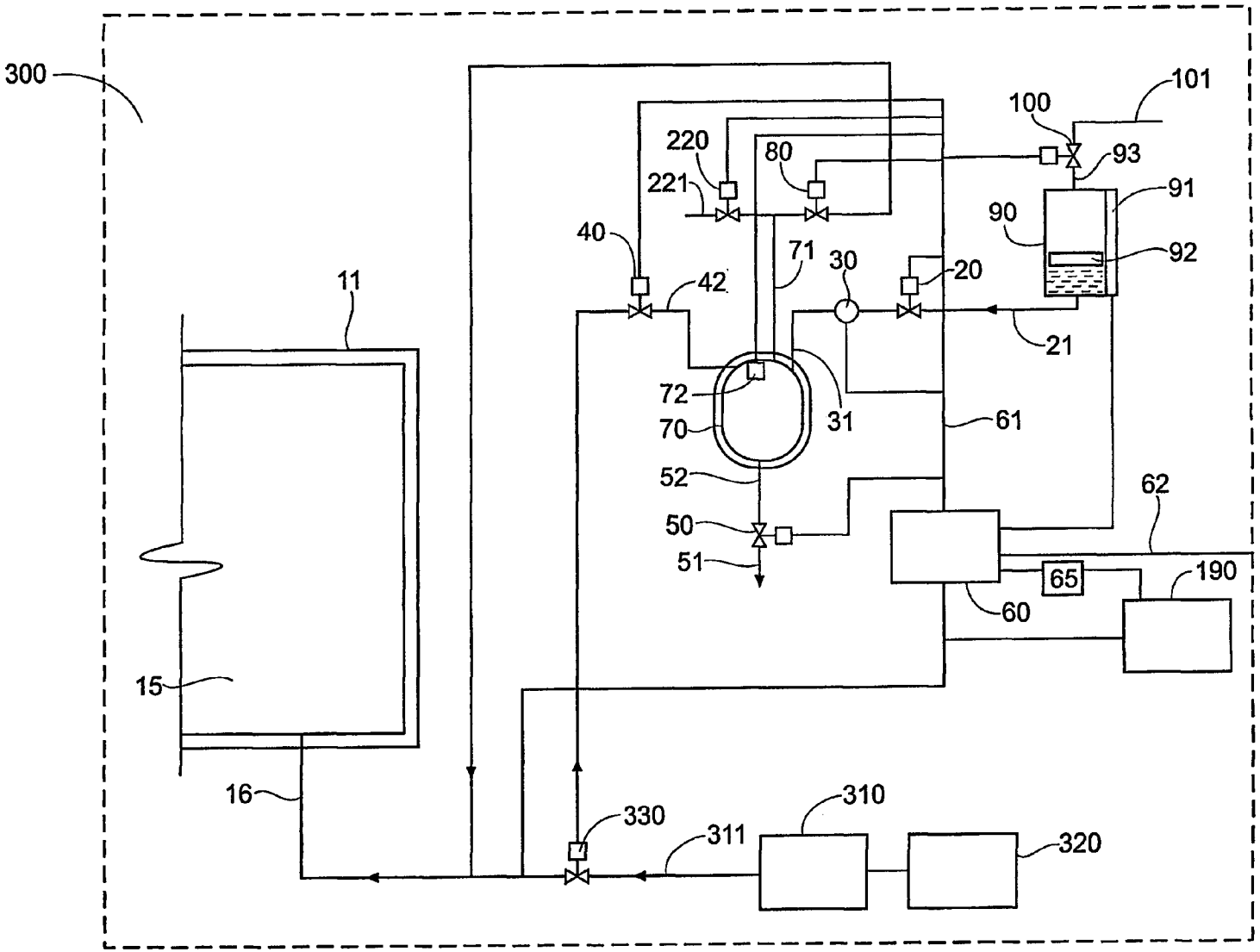
FIG. 10 is a diagrammatic view of a preferred ammonia concentration measurement in the atmosphere generated by the ammonia dissociator of the current invention.

A schematic view of a preferred ammonia dissociation measurement apparatus 300 according to the present invention is shown in FIG. 10. The apparatus 300 is based on the same principal as the furnace atmosphere sensing apparatus 10 shown in FIG. 1., except the apparatus 300 uses a modified gas-sampling configuration.

Figure 11:
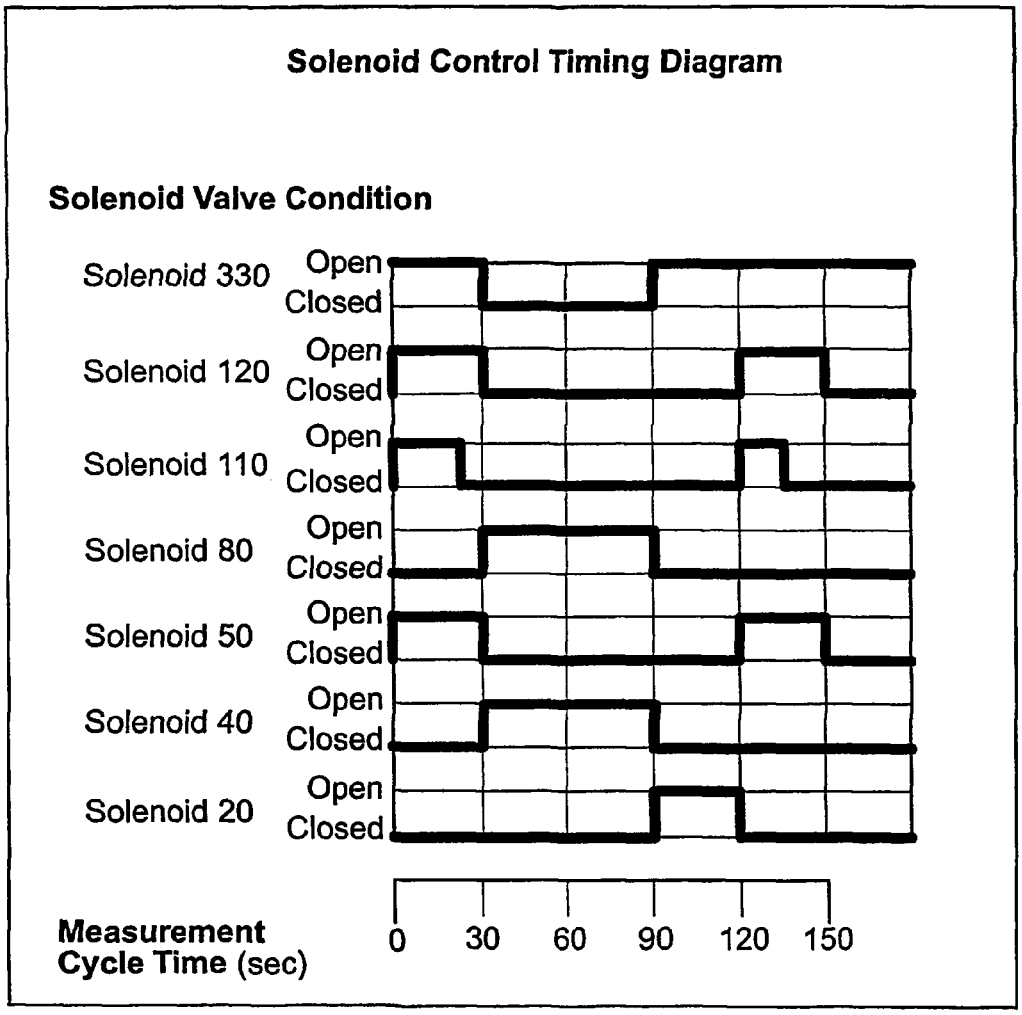
FIG. 11 is a graph of the preferred solenoid condition vs. time associated with the ammonia concentration measurement in the atmosphere generated by the ammonia dissociator apparatus shown in FIG. 10.

FIG. 11 is a chart of a preferred solenoid condition vs. measurement cycle time. The chart is associated with the ammonia concentration measurement in the atmosphere generated by ammonia dissociation apparatus 300 shown in FIG. 10.

An ammonia supply 320 provides ammonia to the dissociator 310. Ammonia is dissociated and exhausted through the output line 311. Solenoids 330 and 40 are connected to the ammonia dissociator outlet 311. Solenoid 330 prevents the gas from flowing directly from the dissociator 310 to the inlet 16 of the furnace 11. The furnace 11 and ammonia dissociator 310 also include heating sources, which are not shown in FIG. 10 for simplicity.

When the ammonia dissociator 310 provides sufficient exhaust gas pressure, a pump is not required. Solenoid valves 40, 80 and 330 direct the dissociated ammonia either directly or through measurement vessel 70 to the furnace 11.

The method for the measurement of the ammonia dissociator gas measurement differs from the method above, relating to FIGS. 1 and 2, in that step b) requires closed solenoid valves 330, 220, 100, 50, 20. Solenoids 40 and 80 are open allowing dissociated ammonia to flow from outlet 311 through valve 40 to the vessel 70 filling it with the atmosphere generated by ammonia dissociator 310. The gas travels from vessel 70 through exhaust line 71 through solenoid 80 to the furnace inlet 16. In the remaining steps solenoid 330 is open, and all other functions are similar to the functions and program described above and associated with FIGS. 1 and 2.

Automatic Calibration of Ammonia Sensing Apparatus

FIGS. 12A and 12B show a flow chart of the ammonia concentration measurement system automatic calibration sequence. With reference to FIGS. 1 and 8, calibration is performed according to the following steps:

a) Solenoid valves 20, 40, 80 are closed. Pump 81 is turned "off". Solenoid valves 50 and 220 are open, allowing water from vessel 70 to drain to the safe location 51. Solenoid valve 100 is opened, letting pressurized water from 101 to flow to the vessel 90. When vessel 90 is filled to predetermined amount, preferably 95% capacity, solenoid 100 is closed. The water level in vessel 90 is precisely measured by measurement sensor 91, sent and stored in controller 60.

b) The water totalization program of controller 60 starts. The program receives and totals flow information from the flow meter 30. The controller 60 also monitors the water level in vessel 90 by reading information from the sensor 91.

c) The calibration timer, preferably set to 20 seconds, starts. Solenoid valve 20 is opened, which allows low-pressure water from vessel 90 to flow to the vessel 70. When solenoid valve 20 is opened and water starts to flow to vessel 70, flowing water volume is measured by the flow meter 30. The water flow to the vessel 70 will stop when pressure created by the water column in vessel 90 is equal to the air pressure in the vessel 70, with the water level drop measured by the sensor 91. Solenoid 20 closes when the calibration timer reaches zero (0) seconds.

d) The program in the microprocessor 60 compares the totalized water flow information with the known volume of the water that is required to fill the vessel 70 in order to create a pressure equal to the water column pressure in the vessel 90. If the totalized water volume value differs from the known volume by more than a predetermined allowed tolerance, the alarm 65 is actuated and the flow meter 30 information is not used in the measurement until the flow meter 30 is calibrated. If water volume difference is within the allowed tolerance, the value is displayed for the operator and is stored in the memory of the controller.

e) The microprocessor 60 program compares the water level difference in the vessel 90 measured by the water level sensor 91, with the known water level difference in vessel 90 that results when vessel 70 is filled to create a pressure in the vessel 70 equal to the water column pressure in the vessel 90. If the water level difference in the vessel 90 measured by the water level sensor 91 differs from the known level difference by more than an allowed tolerance, the alarm 65 is actuated and the water level sensor 91 information is not used in the ammonia concentration measurement until the water level sensor 91 is calibrated. If water level difference is within the allowed tolerance, the value is displayed on the user interface 190 for the operator and is stored in the memory of the controller 60.

f) Solenoids 20 and 220 are opened. The water from vessel 90 will flow through solenoid 20, through flow meter 30 to the vessel 70. Vessel 70 fills with water and activates water sensor 72 when the water level reaches a pre-determined level.

g) When the water level reaches the pre-determined level, a signal from the water sensor 72 is sent to the controller 60, which in turn closes solenoids 20 and 220. Calculations of the flow meter 30 flow volume will stop, as will water level measurements from the sensor 91. The volume of water measured by the flow meter 30 that flowed through solenoid 20, which was also indicated as a water level drop by the sensor 91, should correspond to the known volume of the vessel 70 (volume at the position where sensor 72 is activated).

h) The microprocessor 60 compares totalized water flow information with the known volume of the water that is required to fill vessel 70 to a pre-determined level. If the values differ by more than an allowed tolerance, the alarm is actuated and flow meter 30 information is not used in the measurement until the flow meter 30 is calibrated. If water volume difference is within the allowed tolerance, the value is displayed for the operator and is stored in the memory of the controller 60.

i) The microprocessor 60 compares the water level difference in vessel 90, as reported by the water level sensor 91, with the known water level difference in vessel 90 that results from filling the vessel 70 with a pre-determined volume. If the two levels differ by more than allowed tolerance, the alarm is actuated and the water level sensor 91 information is not used in the ammonia concentration measurement until the water level sensor 91 is calibrated. If the water level difference is within the allowed tolerance, the value is displayed for the operator and is stored in the memory of the controller 60.

j) The exhaust solenoid 50 and the vent solenoid 220 are opened, and water will empty into the measurement vessel 70. The calibration program ends, and the system is ready for the operation measurement.

Technical Features

Overall, the system provides for advantages over the prior art. For instance, in providing a system for heat-treating processes based on ammonia concentration, the system also is less susceptible to have a pressure sensor contaminated by water. Likewise, the present invention provides for a closed-loop atmosphere that is efficiently controlled and which allows for processes to generate alarms if the system is not properly running.

The system may also use multiple sensors. For example, ammonia concentration measurement with water flow meter by a gas dissolution in water method is compared with the ammonia concentration measurement with water column height or weight measurement by a gas dissolution in water method and an output is generated based at least in part upon the comparison. Ammonia concentration in the gas mixture may be measured after ammonia dissociation and before the dissociated ammonia gas is introduced into the heat-treating furnace. The system may also employ automatic process temperature compensation equipment.

The system may be arranged for automatic calibration of the critical measurement sensors used in ammonia concentration in gas mixture measurement, wherein the control of heat-treating processes and atmospheres is based upon measurement of ammonia dissociation or nitriding potential. Such a design, as previously stated, may be based on the use of multiple sensors, such as ammonia or other gas measurement results achieved by infrared or thermal conductivity methods, and an output can be generated based at least in part upon the comparison. The system may then be used for automatically determining the malfunctioning sensor used for measuring ammonia concentration in gas mixture.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A heat-treating system for a steel part comprising:

a heat-treating furnace for receiving said steel part;

an atmosphere source of an ammonia based atmosphere conveyed to said furnace for reaction with said steel part;

a heat source connected to said furnace for maintaining a predetermined temperature of said atmosphere;

a water source including a flow meter;

a vessel connected to said furnace and said water source; and a processor for determining ammonia content of the atmosphere as a function of amount of ammonia dissociated within said vessel, said amount determined, at least in part, by measuring the flow of water into said vessel, said processor also comparing said measured flow of water into said vessel to a second measurement based, at least in part, upon a second water flow meter, reflecting ammonia content of the atmosphere.

2. The heat-treating system according to claim 1 wherein said processor continuously monitors said water flow into said vessel.

3. The heat-treating system according to claim 1 wherein the processor includes an alarm function that is activated when said amount is outside of predetermined limits.

4. The heat-treating system according to claim 3 wherein the alarm function includes a display device.

5. The heat-treating system according to claim 1 wherein the processor includes an output reflecting the ammonia content.

6. The heat-treating system according to claim 5 wherein said processor includes a display for said output.

7. The heat treating system according to claim 5 wherein said processor is coupled to said atmosphere source to control said atmosphere based, at least in part, upon the output.

8. The heat-treating system of claim 1 wherein said second measurement reflecting ammonia content of the atmosphere is based, at least in part, upon a pressure transducer.

9. A method for monitoring a heat-treating system for a steel part, said method comprising:

providing a furnace to house said steel part;

introducing an ammonia based atmosphere into said furnace to react with said steel part;

providing a water source;

providing a flow meter connected to said water source;

providing a measurement vessel connected to said furnace and said water source;

filling said measurement vessel with said ammonia atmosphere and said water source;

measuring the flow rate of said water source;

determining dissociation of ammonia in said system, at least in part, from said flow rate measurement in said measurement vessel;

comparing said flow rate measurement to a predetermined ammonia atmosphere range; and triggering a control signal if said flow rate measurement is outside of said predetermined atmosphere range.

10. The method of claim 9 further comprising the step of recording said flow rate measurement.

11. The method of claim 9 further comprising the steps of:

providing a second flow meter;

comparing values of said second flow meter with said first flow meter; and calibrating said first flow meter according to second flow meter values.

12. The method of claim 9 wherein said step of determining ammonia dissociation is performed before said ammonia atmosphere enters said furnace.

13. The method of claim 9 further comprising the step of providing a processor for determining ammonia dissociation.

14. The method of claim 13 further comprising the step of providing a display and an output for said processor.

15. The method of claim 14 further comprising the step of generating an alarm signal based, at least in part, on said output.

16. A method for monitoring a heat-treating system for a steel part, said method comprising:

providing a furnace to house said steel part;

introducing an ammonia based atmosphere into said furnace to react with said steel part;

providing a water source;

providing a flow meter connected to said water source;

providing a measurement vessel connected to said furnace and said water source;

filling said measurement vessel with said ammonia atmosphere and said water source;

measuring the flow rate of said water source;

determining dissociation of ammonia in said system, at least in part, from said flow rate measurement in said measurement vessel;

providing a second flow meter;

comparing values of said second flow meter with said first flow meter; and calibrating said first flow meter according to second flow meter values.

17. The method of claim 16 further comprising the step of recording said flow rate measurement.

18. The method of claim 16 further comprising the steps of:

comparing said flow rate measurement to a predetermined ammonia atmosphere range; and triggering a control signal if said flow rate measurement is outside of said predetermined atmosphere range.

19. The method of claim 16 wherein said step of determining ammonia dissociation is performed before said ammonia atmosphere enters said furnace.

20. The method of claim 16 further comprising the step of providing a processor for determining ammonia dissociation.

21. The method of claim 20 further comprising the step of providing a display and an output for said processor.

22. The method of claim 21 further comprising the step of generating an alarm signal based, at least in part, on said output.

* * * * *